US005855696A

United States Patent [19]

Tezuka et al.

[11] Patent Number: 5,855,696

[45] Date of Patent: Jan. 5, 1999

[54] ULTRA LOW CARBON, COLD ROLLED STEEL SHEET AND GALVANIZED STEEL SHEET HAVING IMPROVED FATIGUE PROPERTIES AND PROCESSES FOR PRODUCING THE SAME

[75] Inventors: Makoto Tezuka, Kimitsu; Kohsaku Ushioda, Futtsu; Shiro Fujii; Atsushi Itami, both of Kimitsu; Yasuharu Sakuma, Kimitsu; Tatsuo Yokoi, Futtsu, all of Japan

[73] Assignee: Nippon Steel Corporation, Tokyo, Japan

[21] Appl. No.: 737,909

[22] PCT Filed: Mar. 27, 1996

[86] PCT No.: PCT/JP96/00805

§ 371 Date: Mar. 19, 1997

§ 102(e) Date: Mar. 19, 1997

[87] PCT Pub. No.: WO96/30555

PCT Pub. Date: Oct. 3, 1996

[30] Foreign Application Priority Data

Mar. 27, 1995 [JP] Japan ..... 7-068103
Apr. 17, 1995 [JP] Japan ..... 7-090430

[51] Int. Cl.[6] ..... C21D 8/04; C22C 38/04; C22C 38/06

[52] U.S. Cl. ..... 148/330; 148/603; 148/652; 148/651

[58] Field of Search ..... 148/603, 652, 148/651, 330

[56] References Cited

U.S. PATENT DOCUMENTS

| | | | |
|---|---|---|---|
| 5,470,403 | 11/1995 | Yoshinaga et al. | 148/603 |
| 5,486,241 | 1/1996 | Ushioda et al. | 148/603 |

FOREIGN PATENT DOCUMENTS

| | | | |
|---|---|---|---|
| 556834 | 8/1993 | European Pat. Off. | 148/603 |
| A6-81044 | 3/1944 | Japan . | |
| A58-141355 | 8/1983 | Japan . | |
| A59-80724 | 5/1984 | Japan . | |
| A60-103129 | 6/1985 | Japan . | |
| A63-72830 | 4/1988 | Japan . | |
| A63-83230 | 4/1988 | Japan . | |
| A63-317625 | 12/1988 | Japan . | |
| A1-184251 | 1/1989 | Japan . | |
| 5263142 | 10/1993 | Japan | 148/603 |
| A6-81043 | 3/1994 | Japan . | |
| A6-81080 | 3/1994 | Japan . | |
| A6-93376 | 5/1994 | Japan . | |

*Primary Examiner*—Deborah Yee
*Attorney, Agent, or Firm*—Kenyon & Kenyon

[57] ABSTRACT

The cold rolled steel sheet or galvanized steel sheet comprises by weight C: 0.0001 to 0.0026%, Si: not more than 1.2%, Mn: 0.03 to 3.0%, P: 0.015 to 0.15%, S: 0.0010 to 0.020%, Al: 0.005 to 0.1%, N: 0.0005 to 0.0080% and B: 0.0003 to 0.0030% with the balance consisting of Fe and unavoidable impurities. A process for producing the above steel sheet is also provided which comprises the steps of: performing hot roll finishing of a slab having the above chemical composition at the $Ar_3$ transformation point or above; preferably, then cooling the hot rolled strip, within 1.5 sec after the completion of the hot rolling, to 750° C. at a rate of not less than 50° C./sec; coiling the strip in the temperature range of from room temperature to 750° C.; cold rolling the coiled strip a reduction ratio of not less than 70%; subjecting the cold rolled strip to continuous annealing at 600° to 900° C. or to continuous galvanizing by the sendzimer method; and performing temper rolling with a reduction ratio of not less than 1.5×(1–400×C) % and not less than 2080×(C - 0.0015) wherein C represents the carbon content in % by weight.

18 Claims, 12 Drawing Sheets

ULTRA LOW CARBON, COLD ROLLED STEEL SHEET AND GALVANIZED STEEL SHEET HAVING IMPROVED FATIGUE PROPERTIES AND PROCESSES FOR PRODUCING THE SAME

TECHNICAL FIELD

The present invention relates to ultra low carbon, cold rolled steel sheet and galvanized steel sheet, for deep drawing, improved in fatigue properties of the base metal and spot weld zone, and processes for producing the same. The cold rolled steel sheets according to the present invention are those which, after press forming, are used for applications such as automobiles, domestic electric appliances, and buildings, and include both surface untreated cold rolled steel sheets in the narrow sense and cold rolled steel sheets, in the broad sense, which have been subjected to surface treatment for rust preventive purposes, such as Zn plating or alloyed Zn plating, and further provided with an organic film on the plating.

The galvanized steel sheets according to the present invention are similarly those which, after press forming, are used for applications such as automobiles, domestic electric appliances, and buildings and have been subjected to surface treatment for rust preventive purposes, such as galvanizing or alloyed galvanizing.

BACKGROUND ART

Technical advance of vacuum degassing process for a molten steel in recent years has facilitated the production of ultra low carbon steels, leading to an ever-increasing demand for ultra low carbon steel sheets having good workability.

It is well known that such ultra low carbon steel sheets generally contain at least one element selected from the group consisting of Ti and Nb. Ti and Nb exhibit a strong, attractive interaction with interstitial solid solution elements (C, N) in the steel to easily form carbonitrides, enabling a steel free from interstitial solid solution elements (IF steel: interstitial free steel) to be easily produced. IF steels are free from interstitial solid solution elements causative of strain aging and deteriorated workability and, hence, feature a non-aging property and very good workability. Further, the addition of Ti and Nb plays an important role, that is, it refines the diameter of grains, of a hot rolled steel sheet of an ultra low carbon steel, which are likely to be coarsened, and improves the deep drawability of a cold rolled, annealed steel sheet. However, ultra low carbon steels with Ti and Nb added thereto have the following problems. First of all, the production cost is high because the cost associated with the addition of expensive elements such as Ti and Nb is added to the cost of vacuum treatment for achieving ultra low carbon. Secondly, the absence of C and N in solid solution in product sheets results in drawing-induced embrittlement or disappearance of paint bake hardening property (BH property). Thirdly, the base metal and the spot weld zone have poor fatigue properties. The reason for this is that the strength of the material is low due to the nature of the ultra low carbon steel and, in addition, the microstructure of heat-affected zone in the spot welded area is coarsened to form a brittle area. Fourthly, Ti and Nb are strong oxide formers, and the formed oxides deteriorate the surface quality.

A large amount of research and development have been done with a view to solving the above problems of IF steels. One conceivable means for solving the above problems is to use as a base material an ultra low carbon steel with Ti and Nb not added thereto. this is because the use of a steel not containing Ti and Nb, as the base material naturally leads to the solution of the above first, second, and fourth problems. The adoption of such means is found, for example, in Japanese Unexamined Patent Publications (Kokai) No. 63-83230, No. 63-72830, No. 59-80724, No. 60-103129, No. 1-184251, No. 58-141355, and No. 6-93376. In all of the above publications, attention is drawn to the properties influencing the press moldability of an ultra low carbon steel sheet not containing Ti and Nb, such as r value and elongation, and the BH property and the fabrication embrittlement resistance.

Regarding the fatigue properties as the third problem, however, only a few studies have been made. Japanese Unexamined Patent Publication (Kokai) No. 63-317625 discloses a process for producing an ultra low carbon, cold rolled steel sheet excellent in fatigue properties of spot weld zone wherein Ti, Nb, and B are added in combination and the temper rolling is optimized. However, no mention is made of any method of improving fatigue properties in ultra low carbon steels free from Ti and Nb. Japanese Unexamined Patent Publications (Kokai) No. 6-81043, No. 6-81044, and No. 6-81080 disclose an ultra low carbon steel sheet, having excellent fatigue properties and deep drawability, containing at least one member selected from the group consisting of Ti and Nb, and a process for producing the same.

These unexamined publications disclose the method of increasing the yield strength and improving the fatigue properties of the base metal. However, no study, has been made on the fatigue properties of a joint in its spot weld zone. Further, for the above unexamined publications, only ultra low carbon steels with Ti and Nb added thereto are contemplated, and no study is made on ultra low carbon steels contemplated in the present invention, that is, those substantially free from Ti and Nb.

In general, for ultra low carbon steel sheets free from Ti and Nb, the fatigue properties of base metal are poor due to low yield strength, and heat applied at the time of spot welding is likely to cause abnormal grain growth, leading to a possibility that the fatigue properties of the joint in its spot weld zone become unsatisfactory. As described above, no technique for preventing these unfavorable phenomena has been proposed.

DISCLOSURE OF THE INVENTION

An object of the present invention is to solve the above various problems encountered in ultra low carbon steels free from expensive additive elements, such as Ti and Nb.

Thus, the present invention provides a cold rolled steel sheet and a galvanized steel sheet, based on a low carbon steel free from elements, such as Ti and Nb, having a combination of good fatigue resistance of the base metal with good fatigue properties of a spot weld while maintaining excellent deep drawability, and a process for producing the same.

In the case of a simple ultra low carbon steel sheet not using expensive carbonitride formers, such as Ti and Nb, it has been found that since the steel sheet is excessively softened, it is easily deformed upon exposure to pressure from the electrode at the time of spot welding and the contact resistance between the electrode and the steel sheet or between the steel sheets is excessively lowered resulting in narrow optimal welding current range shifted to the higher current side. This disadvantageously requires a large welding machine. Further, this poses a problem that the fatigue properties of base metal have a high correlation with the yield strength of the base metal and are deteriorated. The addition of P and B have been found to be effective in solving the above problems. The addition of P and B enables the strength of the steel sheet to be increased inexpensively and efficiently while increasing the electric resistance. As a result, the welding current can be kept on the low current side. Further, the fatigue resistance of the base metal can also be improved.

On the other hand, in the case of ultra low carbon steel sheets not containing Ti and Nb, abnormal grain growth is likely to occur in the HAZ at the time of spot welding, posing a problem of deteriorated strength and fatigue property of the spot welded joint. The present inventors have made extensive and intensive studies with a view to solving this problem and, as a result, have newly found that the addition of a combination of P and B in an amount exceeding a given level offers significant effect. Further, it has been found that the following means is effective in satisfactorily attaining the above effect. 1) B/N is regulated to less than 1 to permit B in solid solution to exist. 2) A very small amount of Ti and/or Nb is allowed to exist. 3) The temper reduction ratio is regulated as a function of the C content. 4) In the case of steel sheets having a BH property, imparting the BH property is desired because BH treatment results in improved joint strength and fatigue properties of the spot weld zone.

The present invention has been made based on the above idea and novel finding, and the subject matter of the present invention resides in:

an ultra low carbon, cold rolled steel sheet, for deep drawing, improved in fatigue properties of a base metal and a spot weld zone, comprising by weight C: 0.0001 to 0.0026%, Si: not more than 1.2%, Mn: 0.03 to 3.0%, P: 0.015 to 0.15%, S: 0.0010 to 0.020%, Al: 0.005 to 0.15%, N: 0.0005 to 0.0080%, and B: 0.0003 to 0.0030% and, if necessary, further comprising at least one element selected from the group consisting of Ti: 0.0002 to 0.0015% and Nb: 0.0002 to 0.0015%, with the balance consisting of Fe and unavoidable impurities; and a process for producing a cold rolled steel sheet, comprising the steps of: performing hot roll finishing of a slab having the above chemical composition at the $Ar_3$ transformation point or above, coiling the hot rolled strip at room temperature to 750° C., cold rolling the coil with a reduction ratio of not less than 70%, continuously annealing the cold rolled strip in the temperature range of from 60° to 900° C., and temper rolling the annealed strip with a reduction ratio (%) falling within the range specified by the following formulae: $\%\geqq 1.5\times(1-400\times C)$, $\%\geqq 2080\times(C-0.0015)$, $\%<3.0$ and $0.0001\leqq C\leqq 0.0026$ wherein C represents the carbon content in % by weight.

The subject matter of the present invention further resides in:

an ultra low carbon, galvanized steel sheet, for deep drawing, improved in fatigue properties of a base metal and a spot weld zone, comprising by weight C: 0.0001 to 0.0026%, Si: not more than 1.0%, Mn: 0.03 to 2.5%, P: 0.015 to 0.15%, S: 0.0010 to 0.020%, Al: 0.005 to 0.15%, N: 0.0005 to 0.0080% and B: 0.0003 to 0.0030% and, if necessary, further comprising at least one element selected from the group consisting of Ti: 0.0002 to 0.0015% and Nb: 0.0002 to 0.0015%, with the balance consisting of Fe and unavoidable impurities; and a process for producing a galvanized steel sheet, comprising the steps of: performing hot roll finishing of a slab having the above chemical composition at the $Ar_3$ transformation point or above, coiling the hot rolled strip at room temperature to 750° C., cold rolling the coil with a reduction ratio of not less than 70%, galvanizing the cold rolled strip in an in-line annealing type continuous galvanizing system with an annealing temperature of 600° to 900° C., optionally conducting alloying treatment, and temper rolling the galvanized strip with a reduction ratio (%) falling within the range specified by the following formulae: $\%\geqq 1.5\times(1-400\times C.)$, $\%\geqq 2080\times(C-0.0015)$, $\%\leqq 3.0$ and $0.0001\leqq C\leqq 0.0026$ wherein C represents the carbon content in % by weight.

BEST MODE FOR CARRYING OUT THE INVENTION

Figure 1:
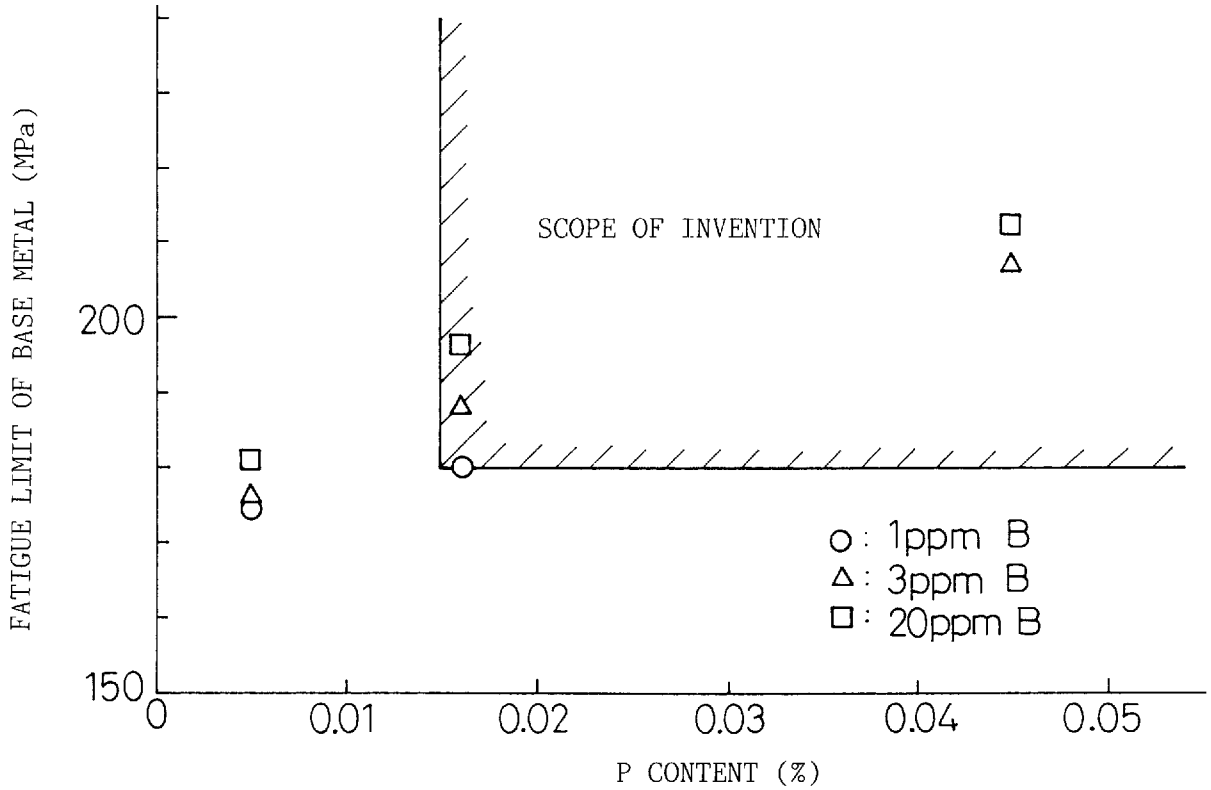
FIG. 1 is a diagram showing the relationship between the fatigue limit of base metal ($2\times10^6$ times) and the P and B contents.
Figure 2:
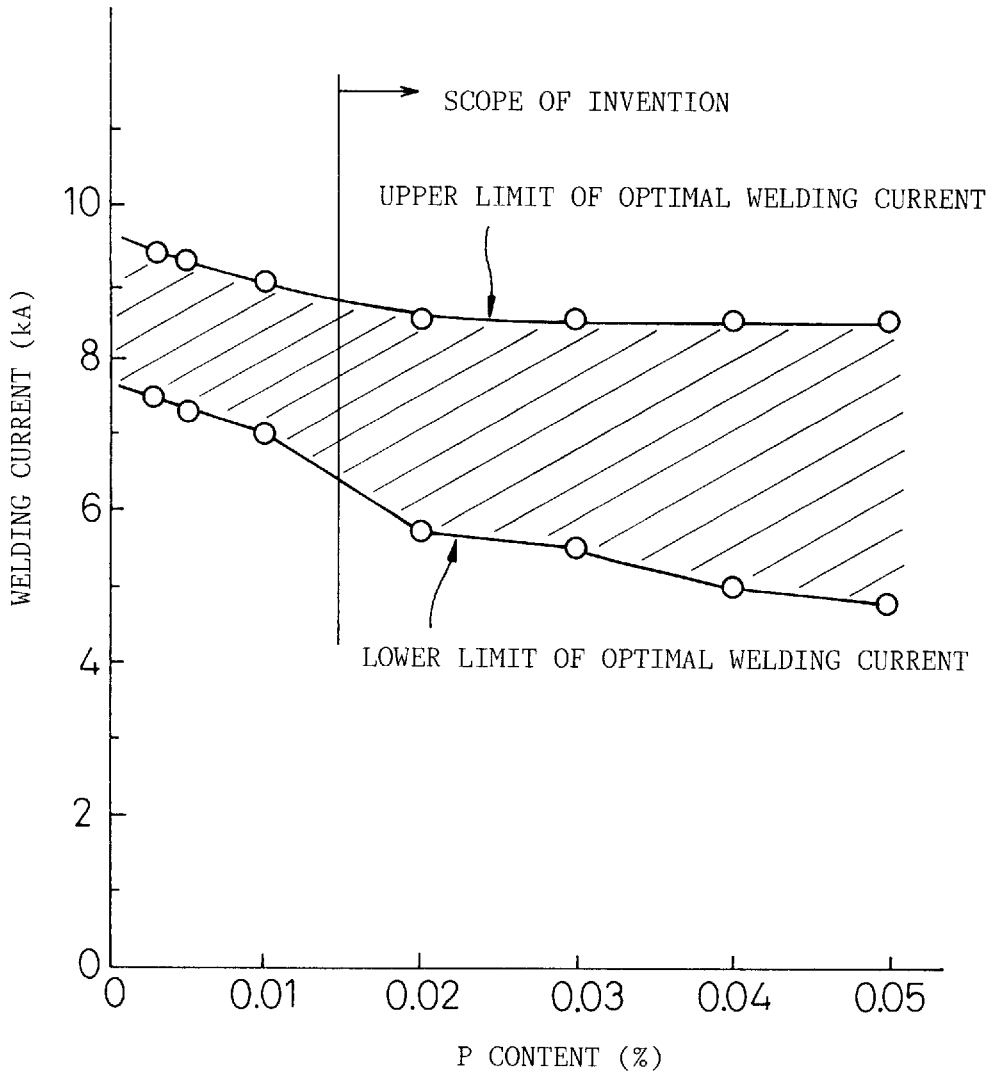
FIG. 2 is a diagram showing the relationship between the optimal spot welding current range and the P content in a steel having a B content of 0.0008%.
Figure 3:
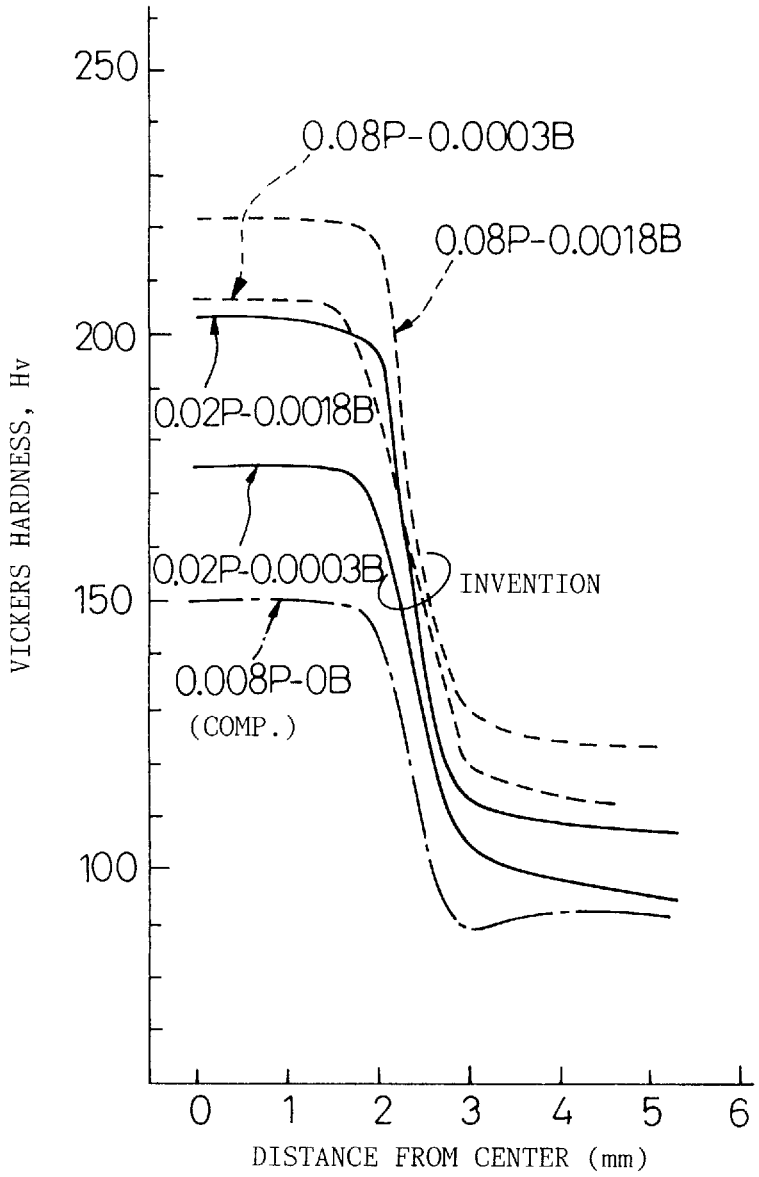
FIG. 3 is a diagram showing the influence of the P and B contents on the hardness distribution in the vicinity of the HAZ after spot welding.

At the outset, the results of experiments which are the basis of the present invention will be described. FIGS. 1, 2 and 3 show the results of investigation on the effect of the addition of P and B, particularly important to the present invention, on the spot weldability and the fatigue property.

In this experiment, a simple ultra low carbon steel sheet containing C: about 0.0013%, Si: 0.01%, Mn: 0.15%, P: 0.003 to 0.18%, S: 0.008%, Al: 0.075: N: 0.0018%, and B: 0.0001 to 0.0040% was used. Hot rolling was performed at a heating temperature of 1150° C. and a finishing temperature of 920° C., and the hot rolled strip was rapidly cooled, within 1.2 sec after the completion of the hot rolling, at a rate of 50° C./sec and coiled at 500° C. The hot rolled sheet having a thickness of 5.0 mm was pickled, cold rolled to a thickness of 0.8 mm (reduction ratio=84%), continuously annealed under conditions of heating rate=10° C./sec, holding=740° C.×50 sec, and cooling=10° C./sec, and temper rolled with a reduction ratio of 1.0%.

The fatigue of the base material was evaluated by subjecting a cold rolled, annealed, temper rolled material according to a pulsating bending fatigue test at 25 Hz according to JIS Z 2273 (a rule concerning a fatigue test method for metallic materials) and JIS Z 2275 (a repeated bending fatigue test for metallic flat plates). The spot weldability was evaluated by conducting welding with reference to the recommended values supplied by RWMA (Resistance Welder Manufacturers' Association) using a CF type electrode having a diameter of 4.5 mm under conditions of applied pressure 200 kgf and weld time was 12 Hz. The optimal welding current range is a range from a current necessary for bringing the nugget diameter to not less than $4\times t^{1/2}$ (t: sheet thickness (mm)) (lower limit of optimal welding current) to a current necessary for causing expulsion and surface flash (upper limit of optimal welding current). Regarding the evaluation of the fatigue strength of the joint, the shear and cross tensile fatigue strengths were evaluated for a material which has been spot welded at a welding current of 95% of the expulsion and surface flash-creating welding current among the above welding conditions.

As is apparent from FIG. 1, the fatigue limit of the base metal at a number of repeats of $2\times10^6$ times for materials having the above composition with not less than 0.015% of P and not less than 0.0003% of B added thereto is better than 180 MPa for a comparative conventional ultra low carbon, cold rolled steel sheet with Ti added thereto, comprising by weight C: 0.0035%, Si: 0.01%, Mn: 0.15%, P: 0.01%, S: 0.01%, Al: 0.03%, Ti: 0.045%, B: 0.0001%, and N: 0.0020%, and can reach the same level as that (208 MPa) for a batch box or pack annealed, low carbon, Al-killed, cold rolled steel sheet comprising by weight C: 0.035%, Si: 0.01%, Mn: 0.15%, P: 0.01%, S: 0.01%, Al: 0.045%, and N: 0.0040%.

As is apparent from the results shown in FIG. 2, for ultra low carbon steels with 0.0008% of B added thereto, increasing the amount of P added broadens the optimal welding current range and shifts the optimal welding current to the lower current side. The present inventors have found that when the amount of P added is not less than 0.015%, the optimal welding current range is on the same level as that for the conventional material.

Figure 4A:
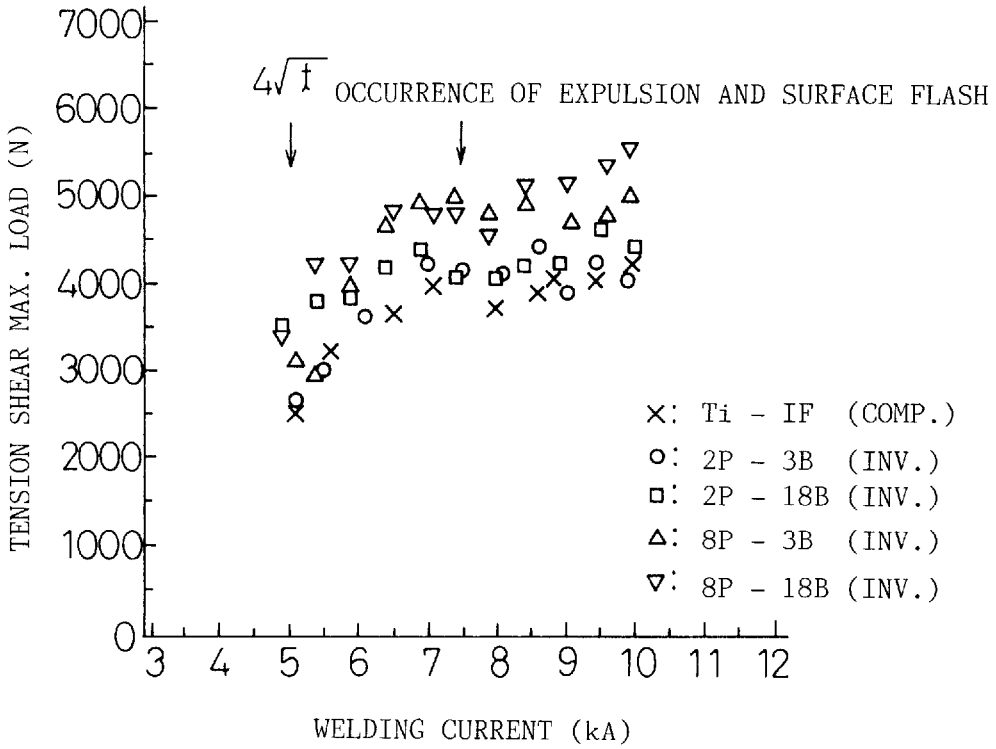
FIG. 4 (A) is a diagram showing the relationship between the tension shear strength of a joint in the spot weld zone and the P and B contents, and FIG. 4 (B) is a diagram showing the relationship between the cross tensile strength of the spot weld zone and the P and B contents.
Figure 4B:
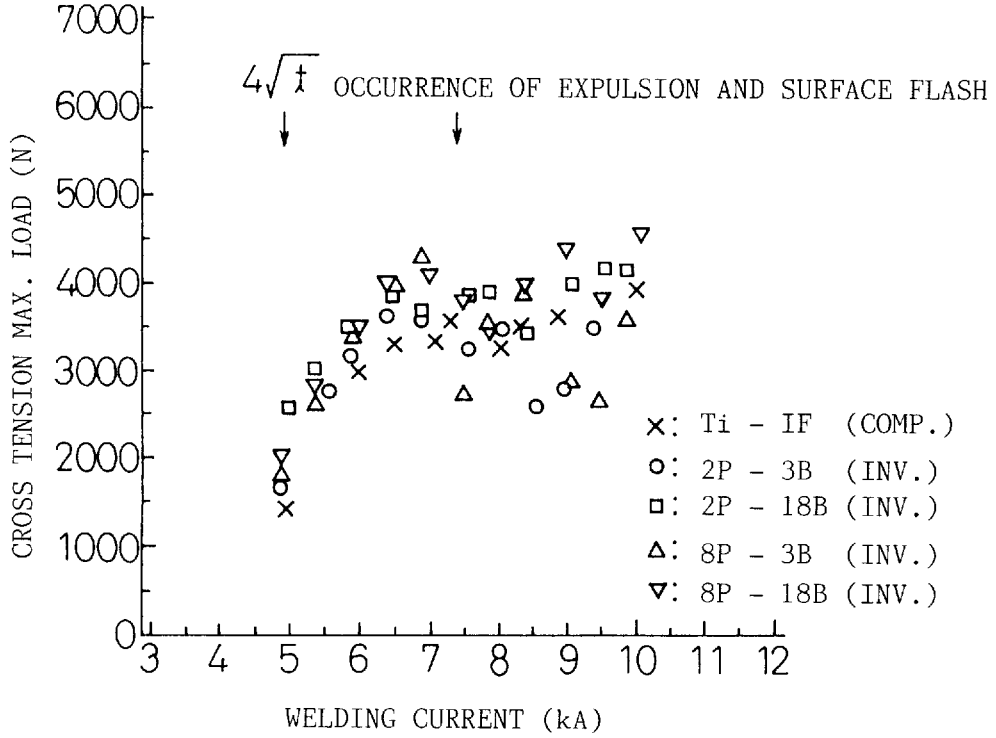
Figure 5A:
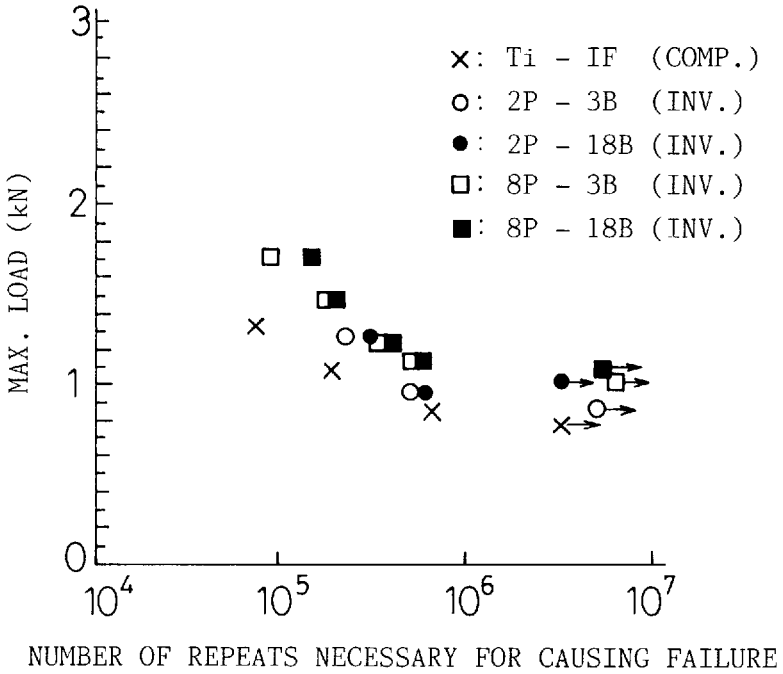
FIG. 5 (A) is a diagram showing the relationship between the joint fatigue property of the spot weld zone before paint baking and the P and B contents, and FIG. 5 (B) is a diagram showing the same relationship as in FIG. 5 (A) except that the spot weld zone has been subjected to paint baking.
Figure 5B:
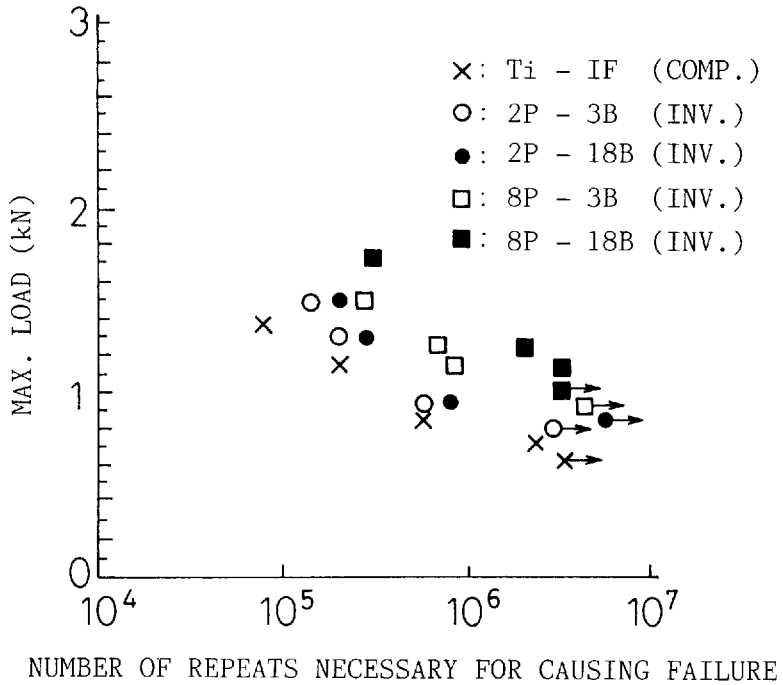

As is apparent from FIG. 3, for the comparative steel, softening in HAZ is present within 3 mm around the center of the spot weld zone, whereas the addition of a combination of P and B in respective proper amounts eliminates such softening, resulting in improved strength of the spot welded joint as shown in FIGS. 4 (A) and (B). Further, as shown in FIG. 5 (A) (before paint baking), the fatigue property of the spot weld zone important to the present invention is also ensured, and, as shown in FIG. 5 (B) (after paint baking), BH treatment results in further improvement. Thus, the present inventors have obtained the above novel finding which is very important for commercialization of ultra low carbon steel sheets with Ti and Nb not added thereto.

In FIGS. 4 (A) and (B) and FIGS. 5 (A) and (B), 2P-3B, 2P-18B, 8P-3B, and 8P-18B are steels of the present invention having compositions falling within the above composition range, wherein the P contents of 2P and 8P are respectively 0.02% and 0.08% and the B contents of 3B and 18B are respectively 0.0003% and 0.0018%. The Ti-IF as the comparative steel has a composition as noted above and is a general ultra low carbon cold rolled steel sheet, with Ti and B added thereto, which is in extensive current use. The metallurgical reason why the addition of P and B in combination can improve the fatigue resistance of the base metal and the spot weldability (including optimal welding current range, joint strength, and the fatigue property of the weld zone) is considered to be as follows.

For the ultra low carbon steel with Ti and Nb not added thereto, C is in solid solution and contributes to an increase in strength. Among substitutional solid solution elements, P is an element having a much smaller atomic radius than Fe, and B also is an interstitial solid solution element. Therefore, these elements effectively increase the yield strength. At the same time, they increase the electric resistance. Consequently, the fatigue property of the base metal is excellent. Further, the optimal welding current range is shifted to the lower current side. P is well known as a grain boundary segregation element and exhibits great interaction with grain boundaries. Therefore, it inhibits grain boundary migration, advantageously refining the microstructure. Further, B and C have attractive interaction and, hence, inhibit $\gamma\rightarrow\alpha$ transformation in the course of cooling after spot welding, contributing to refinement of the microstructure in HAZ and an increase in hardness.

For the ultra low carbon steel sheet with Ti and Nb not added thereto, the effect of refining the microstructure in HAZ attained by P and B synergistically appears when both P and B are present. Although the reason for this has not been elucidated yet, it is considered to be as follows. P and B segregate in $\gamma+\alpha$ transformation boundaries in the course of cooling after spot welding, and, as described above, P lowers the migration rate in grain boundaries while B interacts with C to inhibit the diffusion of C, inhibiting the $\gamma\rightarrow\alpha$ transformation until the temperature becomes low. This improves the hardenability of HAZ and markedly increases the hardness, resulting in improved spot weldability and joint strength and fatigue property of the spot weld zone.

Further, the present inventors have newly found that regulation of the C content and the reduction ratio in temper rolling in respective proper ranges is very effective in imparting the non-aging property and a low lower limit of optimal welding current, at the time of spot welding, which are tasks to be accomplished in ultra low carbon steel sheets with Ti and Nb not added thereto.

Figure 6:
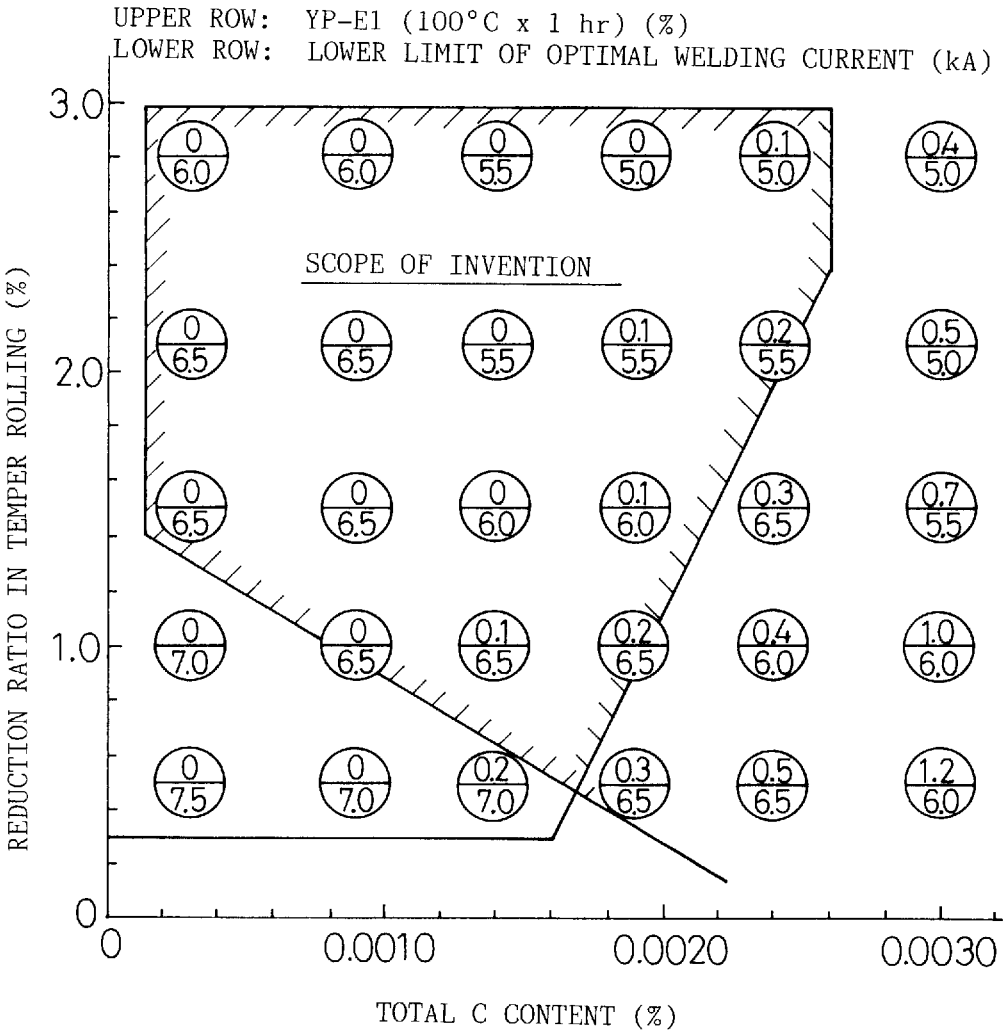
FIG. 6 is a diagram showing the influence of the total C content and the reduction ratio in the temper rolling on the spot weldability (lower limit of optimal welding current) and the aging property (YP-El after 100° C. for 1 hr.)

At the outset, the experimental results which are the basis of finding of the above relationship will be described. FIG. 6 shows the relationship between the C content and the temper rolling conditions influencing the aging property and the lower limit of optimal spot welding current. In the present experiment, simple ultra low carbon steel sheets comprising Si: 0.01%, Mn: 0.15%, P: 0.03%, S: 0.008%, Al: 0.075%, N: 0.0018%, and B: 0.0010% with the amount of C varied in the range of from 0.0003 to 0.0030%. The above sample prepared by the melt process on a laboratory scale was hot rolled. Hot rolling was performed at a heating temperature of 1150° C. and a finishing temperature of 920° C. and coiled at 500° C. The hot rolled sheet having a thickness of 6.0 mm was pickled, cold rolled to a thickness of 0.8 mm (reduction ratio=87%), continuously annealed under conditions of heating rate=10° C./sec, holding=740° C. ×50 sec, and cooling=10° C./sec, and temper rolled with varied reduction ratios.

In FIG. 6, the elongation at yield point (YP-El) in the tensile test after accelerated aging at 100° C. for 1 hr was used as the index of the aging property. Further, the lower limit value of optimal current in spot welding was used as the index of spot weldability. The welding conditions were the same as those described above. As is apparent from the drawing, in order to ensure the non-aging property, the reduction ratio should be regulated in a region defined by a reduction ratio of not less than 0.3%, a C content of not more than 0.0026%, and a reduction ratio of 2080×(C - 0.0015)% or more wherein C represents the C content. The lower limit value of the optimal spot welding current can be kept low by regulating the C content to not less than 0.0001% with the reduction ratio regulated to 1.5×(1–400×C.)% or more. Increasing the total C content increases the content of C in solid solution and, hence, is considered to increase the reduction ratio necessary for imparting the non-aging property. The lower limit value of the optimal spot welding current relates to the strength at yield point (YP) of the material and shifts on lower current side with increasing the YP. For this reason, it is considered that increasing the C content and the reduction ratio in the temper rolling is preferred. The upper limit of the reduction ratio in the temper rolling is 3.0%, and, when the reduction ratio exceeds this value, the steel sheet becomes excessively hard resulting in deteriorated workability.

The reasons for the limitation of chemical compositions of the steel and production conditions will be further described.

(1) C: C is a very important element which determines the quality of products. When the C content exceeds the upper limit 0.0026%, the natural non-aging property is lost even when the reduction ratio in the temper rolling is regulated. Further, in this case, age deterioration in ductility is significant. For the above reason, the upper limit of the C content is 0.0026%. On the other hand, when the C content is less than 0.0001%, the fatigue properties of the base metal and the fatigue properties of the spot weld zone are deteriorated. Further, fabrication embrittlement occurs. In this connection, it should be noted that bringing the C content to the range of from 0.0001 to less than 0.0005% is difficult for reasons of steelmaking techniques and, at the same time, results in increased cost. Therefore, the lower limit of the C content is preferably 0.0005%.

(2) Si: Si is an element which can inexpensively increase the strength. An Si content exceeding 1.2% poses problems of lowered suitability for conversion treatment and plating. Therefore, the upper limit of the Si content is 1.2%.

(3) Mn: Mn, as with Si, is an element which is effective in increasing the strength. Further, in the steel of the present invention, with Ti or the like not added thereto, since Mn fixes S, it serves to prevent cracking at the time of hot rolling. It is said that lowering the Mn content is preferred from the viewpoint of improving the r value. When the Mn content is less than 0.03%, cracking occurs during hot rolling. Therefore, the lower limit of the Mn content is 0.03%. On the other hand, it has been found that Mn is effective in refining grains of a hot rolled steel sheet of an ultra low carbon steel with P added thereto as in the present invention. This is probably because both the elements act so as to thermodynamically countervail the $Ar_3$ temperature and, in addition, kinetically delay the $\gamma \rightarrow \alpha$ transformation. Further, Mn has the effect of refining the microstructure in HAZ in spot welding. An Mn content exceeding 3%, however, results in deteriorated r value, that is, in deteriorated deep drawability. For the above reason, the upper limit of the Mn content is 3%.

(4) P: P, as with Si and Mn, is known as an element which increases the strength, and the amount of P added varies depending upon the target strength level. The diameter of grains of a hot rolled sheet of an ultra low carbon steel with Ti and Nb not added thereto is generally increased. The addition of P in an amount of not less than 0.015% markedly refines the grains and has the effect of improving the deep drawability of cold rolled, annealed product sheets. Further, as described above, the addition of P is useful for ensuring the spot weldability, and, as shown in FIG. 2, the necessary amount of P added is 0.015% or more. On the other hand, the addition of P in an amount exceeding 0.15% results in deteriorated cold rolling property, creation of drawing-induced embrittlement and other unfavorable phenomena. Therefore, the upper limit of the P content is 0.15%.

(5) S: The lower the S content, the better the results. However, when the S content is less than 0.001%, the production cost is remarkably increased. Therefore, the lower limit of the S content is 0.001%. On the other hand, an S content exceeding 0.020% causes excessive precipitation of MnS, deteriorating the workability. For this reason, the upper limit of the S content is 0.020%.

(6) Al: Al is used for the regulation of deoxidation. When the Al content is less than 0.005%, it is difficult to stably conduct the deoxidation, while when it exceeds 0.15%, the cost is increased. Therefore, the lower limit and the upper limit of the Al content are 0.005% and 0.15%, respectively.

(7) N: The lower the N content, the better the results. However, an N content of less than 0.0005% leads to a remarkable increase in cost. Therefore, the lower limit of the N content is 0.0005%. On the other hand, when the N content exceeds 0.0080%, the workability is remarkably deteriorated. For this reason, the upper limit of the N content is 0.0080%.

(8) B: B is an indispensable element for ensuring the joint strength and fatigue properties of the spot weld zone. The addition of B in an amount of not less than 0.0003% is necessary from the viewpoint of attaining the contemplated effect. When the amount of B added is less than 0.0003%, the refinement of the microstructure in HAZ is unsatisfactory, while the addition of B in an amount exceeding 0.0030% results in increased cost and, at the same time, is causative of cracking of the slab. Therefore, the upper limit of the B content is 0.0030%. Preferably, the amount of B added satisfies the relationship B/N>1. This is because B in solid solution which does not form BN is effective in refining the microstructure in HAZ.

(9) Ti, Nb: Fundamentally, these expensive elements are not added in the present invention. As a result of extensive and intensive studies, the present inventors have found that the presence of a very small amount (0.0002 to 0.0015%) of at least one element selected from the group consisting of Ti and Nb results in an improved quality of the product sheets as represented by the r value and the improved strength and fatigue property of the spot weld zone. When the at least one element is added in an amount of less than 0.0002%, the contemplated improvement effect cannot be attained. On the other hand, when it is always added in an amount exceeding 0.0015%, the cost is increased in the actual production on a commercial scale. For this reason, the upper limit of these elements is 0.0015%.

The reasons for the limitation of production conditions will be described.

(9) Hot rolling conditions: Finish hot rolling is performed at the $Ar_3$ temperature or above in order to ensure the workability of the product sheet. Finish hot rolling at a temperature below $Ar_3$ results in a significant increase in diameter of grains of the hot rolled sheet, deteriorating the deep drawability of the product sheet. Further, surface irregularities called "ridging" are created. In the case of an ultra low carbon steel with Ti and Nb not added thereto, rapid cooling, at a rate of not less than 50° C./sec, of the hot rolled sheet within 1.5 sec after the completion of the finish rolling to a temperature of 750° C. or below is preferred because the diameter of grains of the hot rolled sheet is reduced to improved the deep drawability of the final product sheet. Rapid cooling within 0.5 sec after the completion of the finish rolling is particularly preferred. A coiling temperature above 750° C. results in deteriorated pickling property and heterogeneous quality in the longitudinal direction of the coil and, in addition, causes abnormal grain growth during coiling. For this reason, the upper limit of the coiling temperature is 750° C. On the other hand, since lowering of the coiling temperature to room temperature results in no deteriorated workability of the product sheet. Therefore, the lower limit of the coiling temperature is room temperature.

Regarding the hot rolling, it is possible to use a method wherein roughly rolled materials are joined to each other in a period between rough hot rolling and finish hot rolling to conduct finish hot rolling in a continuous manner. Alternatively, conventional batch type hot rolling may be conducted. In the case of continuous hot rolling, the slab is roughly rolled to a thickness of 30 to 70 mm, once coiled, and uncoiled to join the front end of the coil to the rear end of a preceding coil, followed by continuous finish rolling.

(10) Cold rolling conditions: The reduction in cold rolling is limited to not less than 70% from the viewpoint of ensuring the r value of the product sheet. For the ultra low carbon steel sheet contemplated in the present invention, when the reduction ratio is not less than 84%, the $r_{45}$ is markedly improved resulting in reduced in-plane anisotropy of the r value. Further, the microstructure is refined to improve the spot weldability. Therefore, this condition is particularly preferred.

(11) Continuous annealing conditions: Continuous annealing is performed at a temperature of 600° to 900° C. When the annealing temperature is below 600° C., the recrystallization is unsatisfactory, posing a problem associated with the workability of the product sheet. The workability improves with increasing the annealing temperature. However, an annealing temperature above 900° C. causes breaking of the sheet or deteriorates the flatness of the sheet. Further, the workability and the fatigue properties are also deteriorated.

(12) Temper rolling conditions: For an ultra low carbon steel sheet with Ti and Nb not added thereto, the regulation of the reduction ratio in the temper rolling and the C content to respective proper ranges is important from the viewpoint of simultaneously ensuring the non-aging property and the spot weldability. The non-aging property can be ensured by regulating the reduction ratio to a region defined by a reduction ratio of not less than 0.3%, a reduction ratio of 2080×(C - 0.0015)% or more, and a C content of not more than 0.0026%. The lower limit value of the optimal spot welding current can be kept low by regulating the reduction ratio to a region defined by a reduction ratio of 1.5×(1–400×C)% or more and a C content of not less than 0.0001% and increasing YP. The upper limit of the reduction ratio in the temper rolling is 3.0%, and a reduction ratio exceeding 3.0% renders the steel sheet excessively hard, deteriorating the workability of the steel sheet.

The present invention has been made based on the above novel idea and novel finding, and, according to the present invention, cold rolled steel sheets, for deep drawing, having a combination of the natural non-aging property with the BH property and improved in fatigue properties of the base metal and fatigue properties of the spot weld zone can be provided without adding expensive elements such as Ti and Nb.

The ultra low, galvanized steel sheet according to another aspect of the present invention will be described.

It is a matter of course that galvanizing of the cold rolled steel sheet, produced by the above technique, in an in-line annealing type continuous galvanizing system wherein the annealing temperature is 600° to 900° C., can provide a galvanized steel sheet, for deep drawing, improved in fatigue properties of the base metal and the spot weld zone. In order to provide optimal galvanizing conditions particularly for ultra low carbon steel sheets with Ti and Nb not added thereto, the present inventors have made further studies on chemical compositions, production conditions and the like for such steel sheets.

At the outset, the ultra low carbon steel sheet adopted in the above experiment on the quality of cold rolled steel sheets was hot rolled, rapidly cooled, coiled, and cold rolled in the same manner as described above, except that the finish hot rolling temperature was 930° C. For the resultant cold rolled steel strip, a sendzimer type alloyed galvanizing process was simulated. The maximum arrival temperature was 750° C., the Al concentration of the galvanizing bath was 0.12%, and the alloying treatment was performed at 520° C. for 15 sec. The reduction ratio in the temper rolling was 1.2%.

Figure 8:
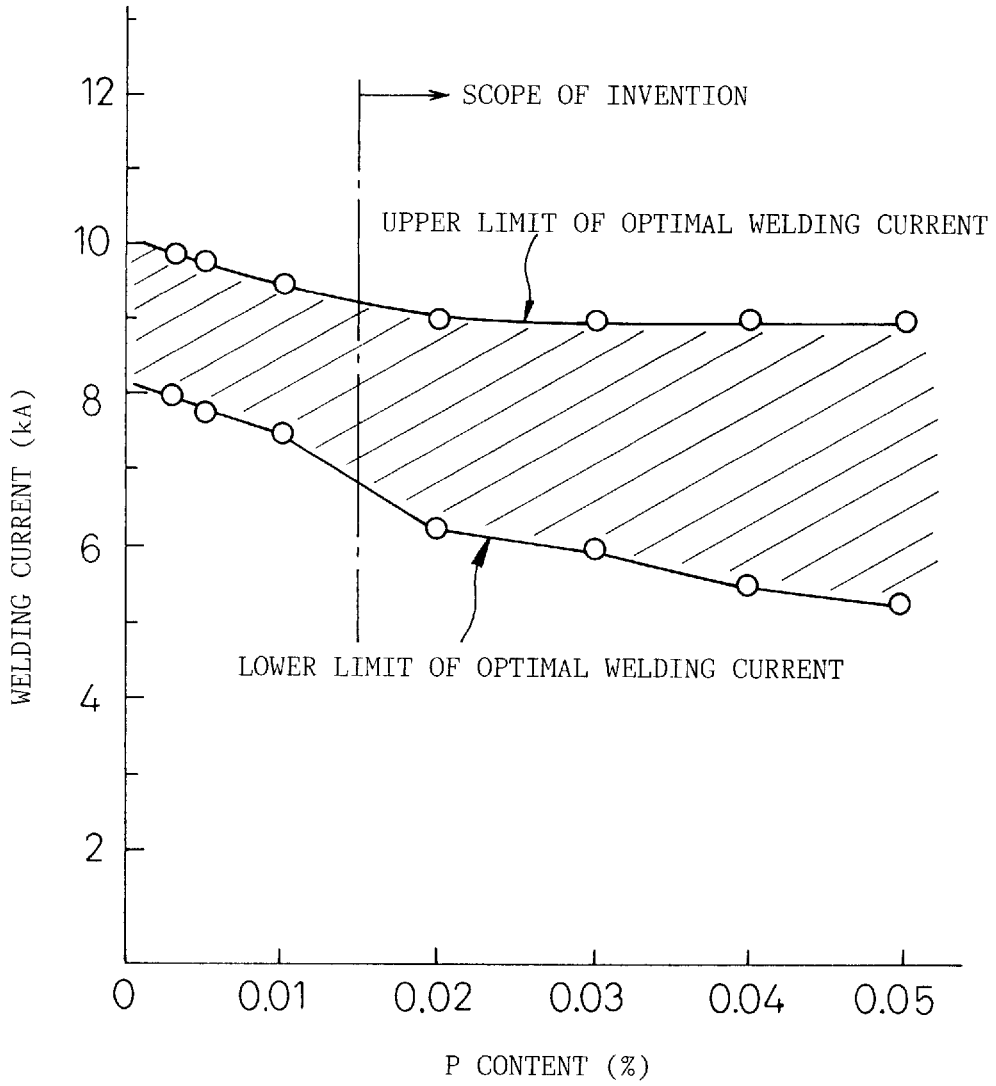
FIG. 8 is a diagram showing the relationship between the optimal spot welding current range and the P content in a further example of the present invention.
Figure 9:
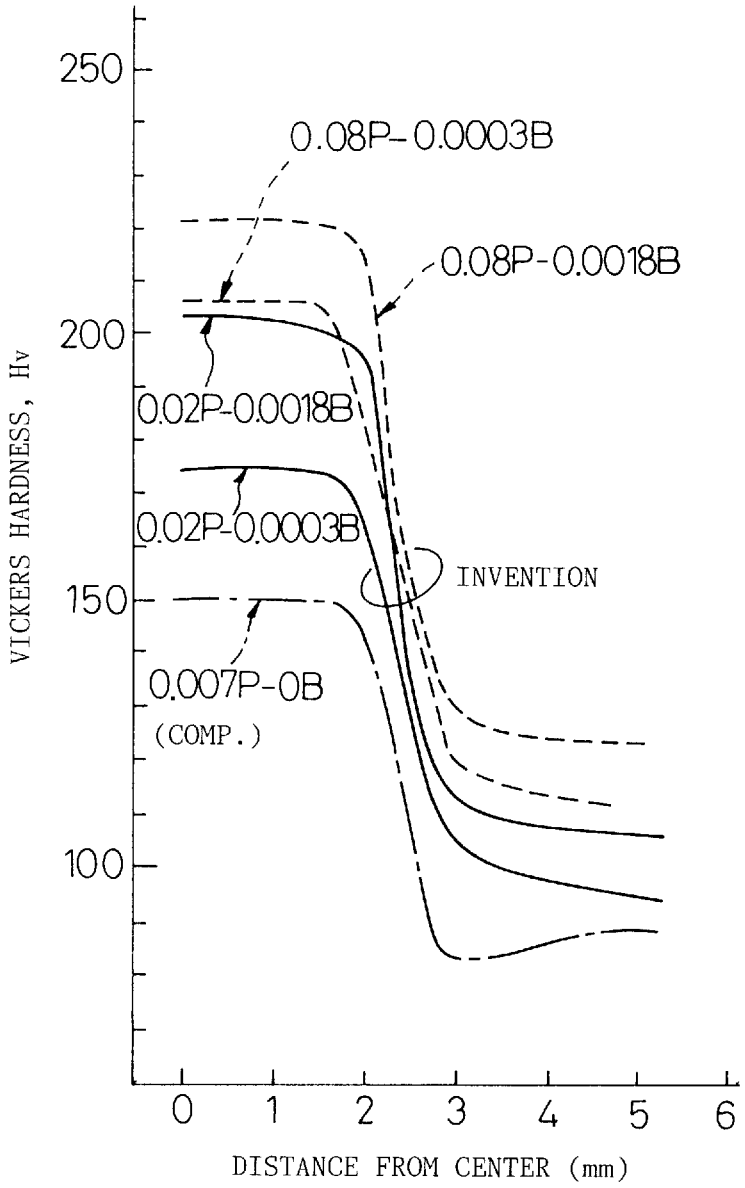
FIG. 9 is a diagram showing the influence of the P and B content on the hardness of distribution in the vicinity of the HAZ after spot welding in a further example of the present invention.

The influence of the addition of P and B in the above galvanized steel sheet on the spot weldability and fatigue properties was investigated by the above experiment. The results are shown in FIGS. 7 to 9.

The fatigue property of the base metal, the spot weldability, the joint fatigue strength and the like were evaluated in the same manner as described above.

Figure 7:
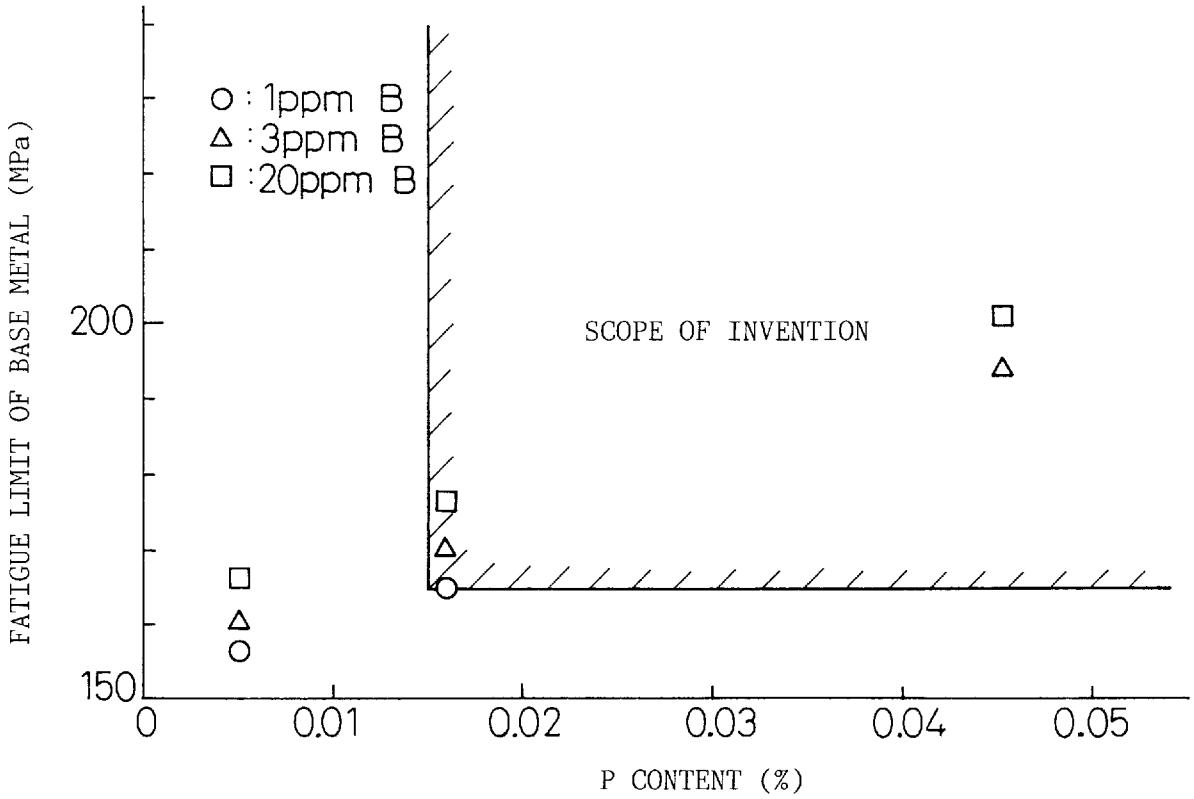
FIG. 7 is a diagram showing the relationship between the fatigue limit ($2\times10^6$ times) and the P and B contents in another example of the present invention.

As is apparent from FIG. 7, the fatigue limit of the base metal at a number of repeats of $2\times10^6$ times for materials having the above composition with not less than 0.015% of P and not less than 0.0003% of B added thereto is better than 165 MPa for a comparative conventional ultra low carbon, alloyed galvanized steel sheet with Ti and Nb added thereto, comprising by weight C: 0.0023%, Si: 0.01%, Mn: 0.15%, P: 0.007%, S: 0.01%, Al: 0.03%, Ti: 0.015%, Nb: 0.011%, B: 0.0001%, and N: 0.0020%, and can reach the same level as that (200 MPa) for a batch box or pack annealed, low carbon, Al-killed, cold rolled steel sheet (comprising by weight C: 0.035%, Si: 0.01%, Mn: 0.15%, P: 0.01%, S:

0.01%, Al: 0.045%, and N: 0.0040%) which has been subjected to alloyed galvanizing and post annealing for imparting the non-aging property.

Figure 10A:
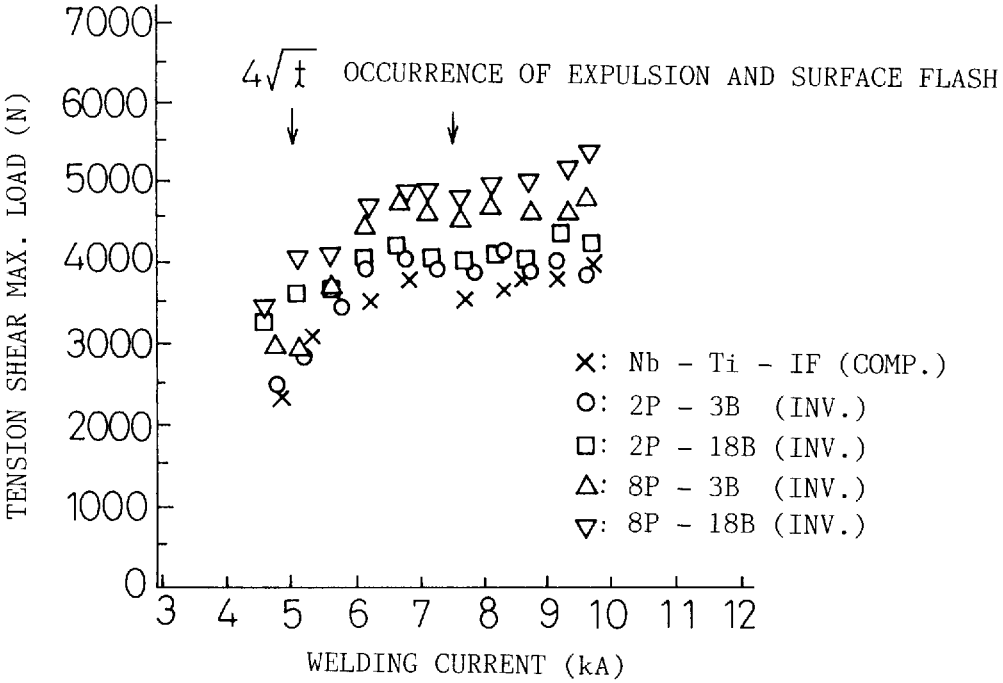
FIG. 10 (A) is a diagram showing the relationship between the tension shear strength of the joint of the spot weld zone and the P and B contents in a further example of the present invention, and FIG. 10 (B) is a diagram showing the relationship between the cross tensile strength of the joint of the spot weld zone and the P and B contents.
Figure 10B:
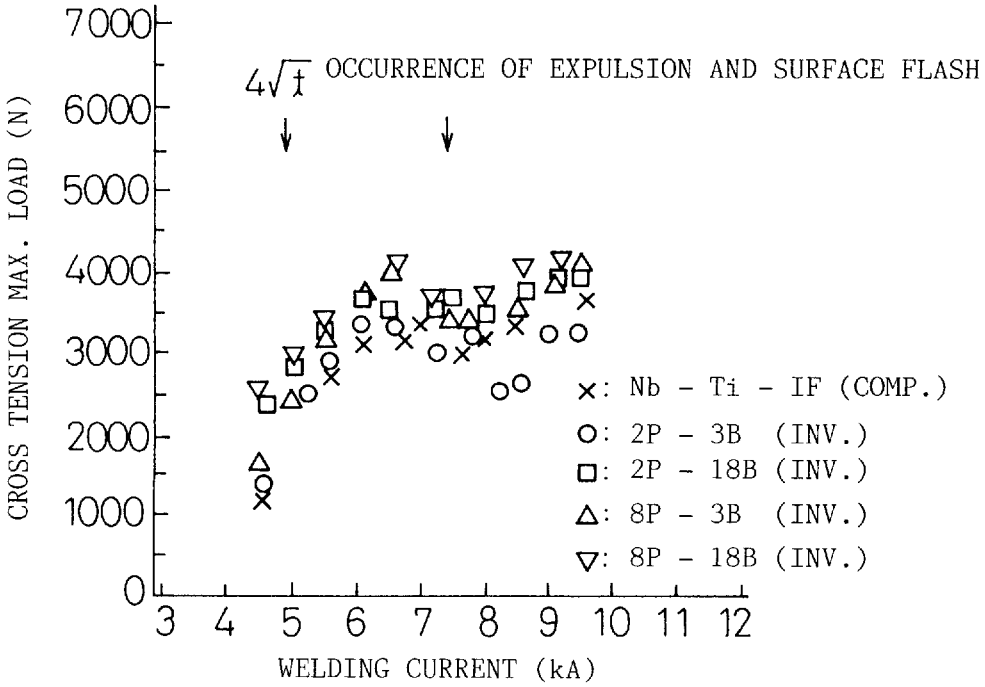
Figure 11A:
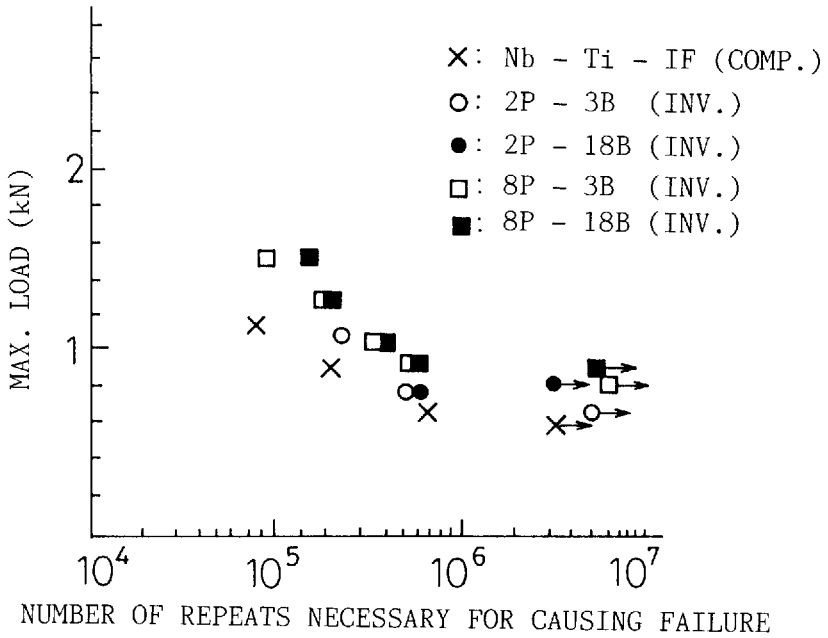
FIG. 11 (A) is a diagram showing the relationship between the shear fatigue property of the joint of the spot weld zone before paint baking and the P and B contents in a further example of the present invention, and FIG. 11 (B) is a diagram showing the same relationship as in FIG. 11 (A) except that the spot weld zone has been subjected to paint baking.
Figure 11B:
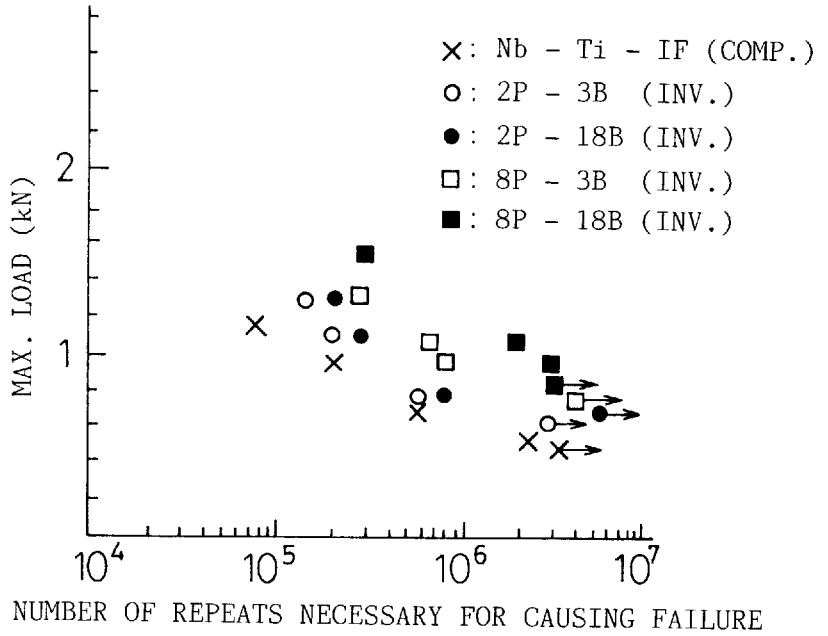

As is apparent from the results shown in FIG. 8, for ultra low carbon steels with 0.0008% of B added thereto, increasing the amount of P added broadens the optimal welding current range and shifts the optimal welding current to the lower current side. The present inventors have found that when the amount of P added is not less than 0.015%, the optimal welding current range is on the same level as that for the conventional material. As is apparent from FIG. 9, for the comparative steel, softening in HAZ is present within 3 mm around the center of the spot weld zone, whereas the addition of a combination of P and B in respective proper amounts eliminates such softening, resulting in improved strength of the spot welded joint as shown in FIGS. 10 (A) and (B). Further, as shown in FIG. 11 (A) (before paint baking), the fatigue property of the spot weld zone important to the present invention is also ensured, and, as shown in FIG. 11 (B) (after paint baking), BH treatment results in further improvement. Thus, the present inventors have obtained the above novel finding which is very important for commercialization of ultra low carbon steel sheets with Ti and Nb not added thereto.

In FIGS. 10 (A) and (B) and FIGS. 11 (A) and (B), 2P-3B, 2P-18B, 8P-3B, and 8P-18B are steels of the present invention having compositions falling within the above composition range, wherein the P contents of 2P and 8P are respectively 0.02% and 0.08% and the B contents of 3B and 18B are respectively 0.0003% and 0.0018%. The Nb-Ti-IF as the comparative steel has a composition as noted above and is an ultra low carbon, alloyed galvanized steel sheet which is in extensive current use.

Next, the results of an experiment for determining the relationship between the C content and the reduction ratio in the temper rolling will be described. In this experiment, the ultra low carbon steel sheet adopted in the above experiment on the cold rolled steel sheets was hot rolled, coiled, pickled, and cold rolled in the same manner as described above. For the resultant cold rolled steel strip, a sendzimer type continuous galvanizing process was simulated. The maximum heating temperature was 750° C., the Al concentration of the galvanizing bath was 0.12%, and the alloying treatment was performed at 520° C. for 12 sec. The reduction ratio in the temper rolling was varied. The results of the above experiment are shown, in FIG. 12, in terms of the influence of the C content and temper rolling conditions on the lower limit value of the optimum spot welding current.

Figure 12:
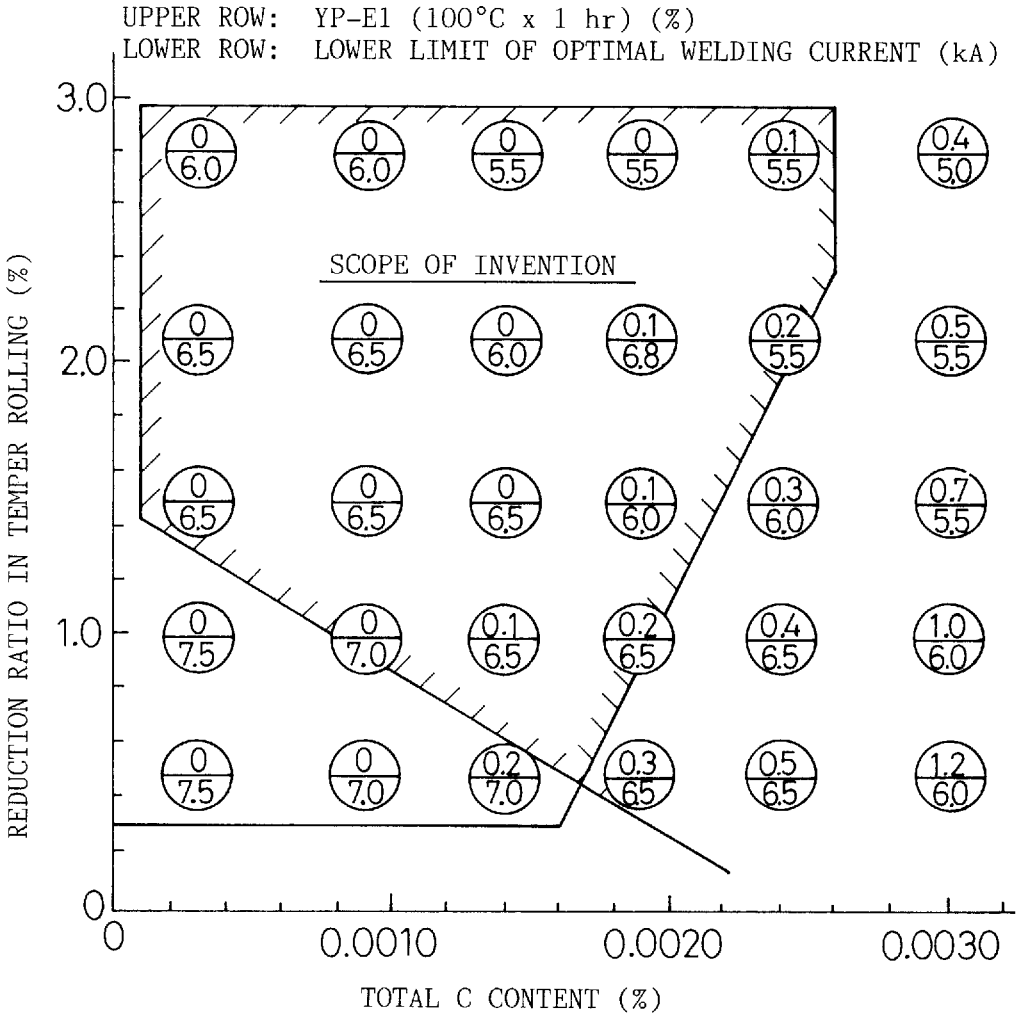
FIG. 12 is a diagram showing the influence of the total C content and the reduction ratio in the temper rolling on the spot weldability (lower limit of optimal welding current) and the aging property (YP-El after 100° C. for 1 hr) in a further example of the present invention.

In FIG. 12, the elongation at yield point (YP-El) in the tensile test after accelerated aging at 100° C. for 1 hr was used as the index of the aging property. Further, the lower limit value of optimal current in spot welding was used as the index of spot weldability. The welding conditions were the same as those described above. As is apparent from the drawing, as with the case of the cold rolled steel sheet, in order to ensure the non-aging property, the reduction ratio should be regulated in a region defined by a reduction ratio of not less than 0.3%, a C content of not more than 0.0026%, and a reduction ratio of 2080×(C - 0.0015)% or more wherein C represents the C content. The lower limit value of the optimal spot welding current can be kept low by regulating the reduction ratio in a region defined by a C content of not less than 0.0001% and a reduction ratio of 1.5×(1–400×C)% or more. The upper limit of the reduction ratio in the temper rolling is 3.0%, and, when the reduction ratio exceeds this value, the steel sheet becomes excessively hard resulting in deteriorated workability.

The reasons for the limitation of chemical compositions of the steel and production conditions will be further described.

(1) C: C is a very important element which determines the quality of products. When the C content exceeds the upper limit 0.0026%, the natural non-aging property is lost even when the reduction ratio in the temper rolling is regulated. Further, in this case, age deterioration in ductility is significant. For the above reason, the upper limit of the C content is 0.0026%. On the other hand, when the C content is less than 0.0001%, the fatigue properties of the base metal and the fatigue properties of the spot weld zone are deteriorated. Further, fabrication embrittlement occurs. Furthermore, bringing the C content to 0.0001% is difficult for reasons of steelmaking techniques and, at the same time, results in increased cost. Therefore, the lower limit of the C content is 0.0001%. In this connection, it should be noted that bringing the C content to the range of from 0.0001 to less than 0.0005% is difficult for reasons of steelmaking techniques and, at the same time, results in increased cost. Therefore, the lower limit of the C content is preferably 0.0005%.

(2) Si: An Si content exceeding 1.0% poses problems of lowered suitability for conversion treatment and plating. Therefore, the upper limit of the Si content is 1.0%.

(3) Mn: An Mn content of less than 0.03% causes cracking during hot rolling. Therefore, the lower limit of the Mn content is 0.03%. On the other hand, an Mn content exceeding 2.5% results in deteriorated r value, that is, deteriorated deep drawability. For the above reason, the upper limit of the Mn content is 2.5%.

(4) P: The addition of P in an amount of not less than 0.015% markedly refines the grains of the hot rolled sheet of an ultra low carbon steel and has the effect of improving the deep drawability of cold rolled, annealed product sheets. Further, the addition of P is useful for ensuring the spot weldability, and, as shown in FIG. 8, the necessary amount of P added is 0.015% or more. On the other hand, the addition of P in an amount exceeding 0.15% results in deteriorated cold rolling property, creation of drawing-induced embrittlement and other unfavorable phenomena. Therefore, the upper limit of the P content is 0.15%.

(5) S: The lower the S content, the better the results. However, when the S content is less than 0.001%, the production cost is remarkably increased. Therefore, the lower limit of the S content is 0.001%. On the other hand, an S content exceeding 0.020% causes excessive precipitation of MnS, deteriorating the workability. For this reason, the upper limit of the S content is 0.020%.

(6) Al: Al is used for the regulation of deoxidation. When the Al content is less than 0.005%, it is difficult to stably conduct the deoxidation. In the present invention wherein the addition of P is a premise, P inhibits an alloying reaction. Since, however, Al and P exhibit attractive interaction, in a steel with Al added in a satisfactory amount, the delayed alloying reaction becomes a normal one. Therefore, the amount of Al added is preferably not less than 0.04%. On the other hand, when the amount of Al added exceeds 0.15%, the cost is increased. Therefore, the lower limit and the upper limit of the Al content are 0.005% and 0.15%, respectively.

(7) N: The lower the N content, the better the results. However, an N content of less than 0.0005% leads to a remarkable increase in cost. Therefore, the lower limit of the N content is 0.0005%. On the other hand, when the N content exceeds 0.0080%, the workability is remarkably deteriorated. For this reason, the upper limit of the N content is 0.0080%.

(8) B: B is an indispensable element for ensuring the joint strength and fatigue properties of the spot weld zone. The addition of B in an amount of not less than 0.0003% is necessary from the viewpoint of attaining the contemplated effect. When the amount of B added is less than 0.0003%, the refinement of the microstructure in HAZ is unsatisfactory, while the addition of B in an amount exceeding 0.0030% results in increased cost and, at the same time, is causative of cracking of the slab. Therefore, the upper limit of the B content is 0.0030%. Preferably, the amount of B added satisfies the relationship B/N>1. This is because B in solid solution which does not form BN is effective in refining the microstructure in HAZ.

(9) Ti, Nb: Fundamentally, these expensive elements are not added in the present invention. However, the presence of a very small amount (0.0002 to 0.0015%) of at least one element selected from the group consisting of Ti and Nb results in improved quality, of product sheets, represented by r value and improved strength and fatigue property of the spot weld zone. When the at least one element is always added in an amount exceeding 0.0015%, the cost is increased in actual production on a commercial scale. For this reason, the amount of Ti and Nb added is limited to the above range.

The reasons for the limitation of production conditions will be described.

(10) Hot rolling conditions: As in the production of the cold rolled steel sheet, the hot rolling may be continuous hot rolling wherein roughly rolled strips are jointed in a period between the rough hot rolling and the finish hot rolling, or alternatively conventional batch type hot rolling. Finish hot rolling is performed at the $Ar_3$ temperature or above in order to ensure the workability of the product sheet. Finish hot rolling at a temperature below $Ar_3$ results in significant increase in diameter of grains of the hot rolled sheet, deteriorating the deep drawability of the product sheet. Further, surface irregularities called "ridging" are created. In the case of an ultra low carbon steel with Ti and Nb not added thereto, rapid cooling, at a rate of not less than 50° C./sec, of the hot rolled sheet within 1.5 sec after the completion of the finish rolling to a temperature of 750° C. or below is preferred because the diameter of grains of the hot rolled sheet is reduced to improved the deep drawability of the final product sheet. Rapid cooling within 0.5 sec after the completion of the finish rolling is particularly preferred. A coiling temperature above 750° C. results in deteriorated pickling property and heterogeneous quality in longitudinal direction of the coil and, in addition, causes abnormal grain growth during coiling. For this reason, the upper limit of the coiling temperature is 750° C. On the other hand, since lowering of the coiling temperature to room temperature results in no deteriorated workability of the product sheet, the lower limit of the coiling temperature is room temperature.

(11) Cold rolling conditions: The reduction in cold rolling is limited to not less than 70% from the viewpoint of ensuring the r value of the product sheet. For the ultra low carbon steel sheet contemplated in the present invention, when the reduction ratio is not less than 84%, the $r_{45}$ is markedly improved resulting in reduced in-plane anisotropy of the r value. Further, the microstructure is refined to improve the spot weldability. Therefore, this condition is particularly preferred.

(12) Continuous galvanizing conditions: Annealing, galvanizing, and optional alloying treatment are carried out in a sendzimer type continuous galvanizing system. The alloying treatment aims to improve the coatability and weldability of the galvanized steel sheet. It is performed in the temperature range of from 450° to 550° C. from the viewpoint of providing a $\sigma_1$ homogeneous phase. The annealing temperature is 600° to 900° C. When the annealing temperature is below 600° C., the recrystallization is unsatisfactory, posing a problem associated with the workability of the product sheet. The workability improves with increasing the annealing temperature. However, an annealing temperature above 900° C. causes breaking of the sheet or deteriorates the flatness of the sheet. Further, the workability and the fatigue properties are also deteriorated.

(13) Temper rolling conditions: For an ultra low carbon steel sheet with Ti and Nb not added thereto, the regulation of the reduction ratio in the temper rolling and the C content to respective proper ranges is important from the viewpoint of simultaneously ensuring the non-aging property and the spot weldability. The non-aging property can be ensured by regulating the reduction ratio to a region defined by a reduction ratio of not less than 0.3%, a reduction ratio of 2080×(C - 0.0015)% or more, and a C content of not more than 0.0026%. The lower limit value of the optimal spot welding current can be kept low by regulating the reduction ratio to 1.5×(1–400×C) % or more and increasing YP.

The upper limit of the reduction ratio in the temper rolling is 3.0%, and when the reduction ratio exceeds 3.0%, the steel sheet is excessively hard, deteriorating the workability.

Thus, according to the present invention, galvanized steel sheets, for deep drawing, having a combination of the natural non-aging property with the BH property and improved in fatigue properties of the base metal and fatigue properties of the spot weld zone can be provided without adding expensive elements such as Ti and Nb.

EXAMPLE 1

Continuously cast slabs of steels specified in Table 1 were heated to 1150° C., hot rolled with the finish rolling temperature being 920° C. to prepare 5.5 mm-thick hot rolled plates, cooled within 1.0 sec after the completion of the hot rolling at a rate of 50° C./sec, and coiled at 600° C. They were then cold rolled with a reduction ratio of 85% to a thickness of 0.8 mm. Among the cold rolled steel strips, those from the steels A to E and H to J were continuously annealed at 740° C. and temper rolled with a reduction ratio of 1.2%. The steel sheets thus obtained were examined for various mechanical properties of each steel sheet, the fatigue strength of the base metal, the minimum welding current, and the shear strength and cross fatigue strength of the spot weld zone. The results are summarized in Table 2. The spot welding was performed under conditions as described above, and the strength of the spot weld zone was evaluated in terms of the value of 95% of a welding current which causes expulsion and surface flash. As is apparent from Tables 1 and 2, the steels of the present invention provided non-aging, cold rolled steel sheets, for deep drawing, excellent in fatigue resistance of the base metal and fatigue strength of the spot weld zone. Further, the regulation of the C content could impart a bake hardening property (BH property). BH treatment (the BH treatment referring to aging treatment which simulates the step of painting and baking after molding, under conditions of 170° C.×20 min after predeformation by 2%) of the steel sheets having a BH property resulted in further improved fatigue strength of the base metal and fatigue strength of spot welded joint. By contrast, the comparative steels outside the scope of the present invention was unsatisfactory in fatigue strength of the base metal and fatigue strength of the spot welded zone (steels I and J), $r_{45}$ (steels H and I), and YP-E1 after exposure to 100° C. for 1 hr (steel H).

TABLE 1

| Steel | C | Si | Mn | P | S | Al | N | Ti | Nb | B | B/N | (wt %) Remarks |
|---|---|---|---|---|---|---|---|---|---|---|---|---|
| A | 0.0012 | 0.01 | 0.15 | 0.03 | 0.008 | 0.075 | 0.0015 | — | — | 0.0007 | 0.47 | Inv. |
| B | 0.0013 | 0.04 | 0.15 | 0.05 | 0.008 | 0.075 | 0.0015 | — | — | 0.0010 | 0.67 | |
| C | 0.0023 | 0.01 | 0.23 | 0.08 | 0.007 | 0.070 | 0.0013 | — | — | 0.0018 | 1.38 | |
| D | 0.0018 | 0.02 | 0.12 | 0.04 | 0.009 | 0.063 | 0.0014 | 0.0008 | — | 0.0011 | 0.79 | |
| E | 0.0008 | 0.01 | 0.13 | 0.03 | 0.008 | 0.060 | 0.0012 | 0.0003 | 0.0005 | 0.0006 | 0.50 | |
| F | 0.0013 | 0.04 | 0.15 | 0.05 | 0.008 | 0.038 | 0.0015 | — | — | 0.0010 | 0.67 | |
| G | 0.0008 | 0.01 | 0.43 | 0.03 | 0.008 | 0.060 | 0.0012 | 0.0003 | 0.0005 | 0.0006 | 0.50 | |
| H | 0.0030 | 0.01 | 0.15 | 0.01 | 0.008 | 0.050 | 0.0018 | — | — | 0.0001 | 0.06 | Comp. |
| I | 0.0012 | 0.01 | 0.15 | 0.007 | 0.010 | 0.062 | 0.0017 | — | — | 0.0005 | 0.29 | |
| J | 0.0030 | 0.01 | 0.15 | 0.01 | 0.008 | 0.032 | 0.0018 | 0.051 | — | 0.0001 | 0.05 | |
| K | 0.0023 | 0.01 | 0.15 | 0.007 | 0.010 | 0.032 | 0.0018 | 0.015 | 0.010 | 0.0001 | 0.05 | |

(Note)
Underlined condition is outside the scope of the invention.

TABLE 2

| Steel | YP (MPa) | TS (MPa) | T-EI (%) | $r_m$ | $r_{45}$ | YP-EI (%) | BH (MPa) | $\sigma_w$ (MPa) BH Front | $\sigma_w$ (MPa) BH Rear | $1_{op}$ (KA) | Fatigue strength limit of spot weld zone ($2 \times 10^6$) Shear plane (KN) BH Front | Shear plane (KN) BH Rear | Cross (KN) BH Front | Cross (KN) BH Rear | Remarks |
|---|---|---|---|---|---|---|---|---|---|---|---|---|---|---|---|
| A | 172 | 316 | 48 | 1.8 | 1.6 | 0 | 35 | 194 | 199 | 5.5 | 0.94 | 0.95 | 0.13 | 0.13 | Inv |
| B | 191 | 333 | 46 | 1.9 | 1.7 | 0 | 37 | 202 | 207 | 5.5 | 1.03 | 1.04 | 0.14 | 0.15 | |
| C | 218 | 354 | 43 | 1.8 | 1.7 | 0.1 | 41 | 215 | 222 | 5.5 | 1.08 | 1.10 | 0.15 | 0.15 | |
| D | 182 | 325 | 46 | 2.0 | 1.8 | 0 | 34 | 202 | 205 | 5.5 | 1.09 | 1.10 | 0.15 | 0.15 | |
| E | 157 | 297 | 49 | 2.0 | 1.8 | 0 | 30 | 182 | 184 | 5.5 | 1.10 | 1.11 | 0.15 | 0.16 | |
| H | 153 | 292 | 50 | 1.7 | 1.3 | 0.4 | 58 | 178 | 188 | 5.5 | 0.96 | 0.98 | 0.13 | 0.14 | Comp. |
| I | 145 | 283 | 52 | 1.5 | 1.1 | 0 | 25 | 172 | 174 | 6.0 | 0.88 | 0.89 | 0.12 | 0.12 | |
| J | 141 | 297 | 49 | 1.9 | 1.7 | 0 | 0 | 170 | 170 | 5.5 | 0.90 | 0.90 | 0.12 | 0.12 | |

$\sigma_w$: Fatigue strength limit of base metal ($2 \times 10^6$)
$1_{op}$: Lower limit of optimal welding current
(Note)
Underlined condition is outside the scope of the invention.

EXAMPLE 2

The steel A specified in Table 1 was treated in the same manner as in Example 1 up to the step of continuous annealing. The annealed strip was then temper rolled with various reduction ratios ranging from 0.5 to 3.0% and then examined for the elongation at yield point of each steel sheet after artificial aging at 100° C. for 1 hr, the lower limit of proper spot welding current, and the fatigue strength of base metal. The results are summarized in Table 3. The spot welding was performed under conditions as described above, and the weld strength was evaluated in terms of the value of 95% of a welding current which causes expulsion and surface flash. As is apparent from Table 3, the regulation of the reduction ratio of the temper rolling in the proper range specified in the present invention can offer a combination of satisfactory non-aging property, weldability, and fatigue properties.

TABLE 3

| Degree of temper rolling | 0.3% or more and 2080 × (C − 0.0015)% or more (non-aging requirement) | 1.5 × (1–400 × C)% or more (weldability requirement) | YP-EI (%) | Lower limit of optimal welding current (KA) | Fatigue limit of base metal under pulsating ($2 \times 10^6$) | Remarks |
|---|---|---|---|---|---|---|
| 0.2 | ≧0.3 | ≧0.78 | 0.3 | 6.5 | 182 | Comp. |
| 0.7 | ≧0.3 | ≧0.78 | 0.1 | 6.0 | 185 | |
| 1.5 | ≧0.3 | ≧0.78 | 0 | 5.0 | 187 | Inv. |
| 2.2 | ≧0.3 | ≧0.78 | 0 | 4.5 | 205 | |
| 3.0 | ≧0.3 | ≧0.78 | 0 | 4.5 | 235 | |

(Note)
Underlined condition is outside the scope of the invention.

EXAMPLE 3

Cold rolled steel strips prepared, in Example 1, from steels A, C, D, F, G, H, I, and K specified in Table 1 were heated at a rate of 10° C./sec to 760° C., the maximum arrival temperature, cooled to 480° C. at a rate of about 10° C./sec, galvanized by the conventional method in a plating bath at 460° C. (Al concentration of the bath: 0.12%), further heated at 520° C. for 20 sec, thereby conducting alloying, and cooled to room temperature at a rate of about 10° C./sec. They were further temper rolled with a reduction ratio of 1.2%.

The steel sheets thus obtained were examined for the various mechanical properties of each steel sheet, the fatigue strength of the base material, the minimum welding current, and the shear strength and cross fatigue strength of the spot weld zone in the same manner as in Example 1. The results are summarized in Table 4.

As is apparent from Tables 1 and 4, the steels of the present invention provided non-aging, alloyed galvanized steel sheets, for deep drawing, excellent in fatigue resistance of the base metal and fatigue strength of the spot weld zone.

TABLE 4

| | | | | | | | | $\sigma_w$ (MPa) | | | Fatigue strength limit of Spot weld zone ($2 \times 10^6$) | | | | |
|---|---|---|---|---|---|---|---|---|---|---|---|---|---|---|---|
| | YP | TS | T-EI | | | YP-EI | BH | BH | | $1_{op}$ | shear plane (KN) BH | | Cross (KN) BH | | |
| Steel | (MPa) | | (%) | $r_m$ | $r_{45}$ | (%) | (MPa) | Front | Rear | (KA) | Front | Rear | Front | Rear | Remarks |
| A | 187 | 321 | 47 | 1.7 | 1.5 | 0 | 37 | 184 | 189 | 6.5 | 0.89 | 0.90 | 0.12 | 0.12 | Inv |
| C | 227 | 365 | 42 | 1.7 | 1.6 | 0.1 | 45 | 205 | 212 | 6.0 | 1.03 | 1.05 | 0.14 | 0.14 | |
| D | 192 | 337 | 45 | 1.9 | 1.7 | 0 | 40 | 192 | 195 | 6.0 | 1.04 | 1.05 | 0.14 | 0.14 | |
| F | 203 | 345 | 45 | 1.8 | 1.6 | 0 | 36 | 192 | 197 | 6.0 | 0.98 | 0.99 | 0.13 | 0.14 | |
| G | 172 | 309 | 48 | 1.9 | 1.7 | 0 | 30 | 172 | 174 | 6.0 | 1.05 | 1.00 | 0.14 | 0.15 | |
| H | 169 | 310 | 48 | 1.5 | 1.1 | 0.4 | 59 | 168 | 178 | 6.5 | 0.91 | 0.93 | 0.12 | 0.13 | Comp. |
| I | 163 | 302 | 50 | 1.3 | 0.9 | 0 | 28 | 162 | 164 | 7.0 | 0.83 | 0.84 | 0.11 | 0.11 | |
| K | 162 | 309 | 47 | 1.7 | 1.5 | 0 | 0 | 160 | 160 | 6.0 | 0.85 | 0.85 | 0.11 | 0.11 | |

$\sigma_w$: Fatigue strength limit of base metal ($2 \times 10^6$)
$1_{op}$: Lower limit of optimal welding current
(Note) Underlined condition is outside the scope of the invention.

EXAMPLE 4

The steel A specified in Table 1 was treated in the same manner as in Example 3 up to the step of continuous galvanizing. The galvanized sheet was then temper rolled with various reduction ratios ranging from 0.5 to 3.0% and then examined for the elongation at yield point of each steel sheet after artificial aging at 100° C. for 1 hr, the lower limit of proper spot welding current, and the fatigue strength of base metal. The results are summarized in Table 5. The spot welding was performed under conditions as described above, and the weld strength was evaluated in terms of the value of 95% of a welding current necessary for causing expulsion and surface flash. As is apparent from Table 5, the regulation of the reduction ratio of the temper rolling in the proper range specified in the present invention can offer a combination of satisfactory non-aging property, spot weldability, and fatigue properties.

TABLE 5

| Degree of temper rolling | 0.3% or more and 2080 × (C − 0.0015)% or more (non-aging requirement) | 1.5 × (1−400 × C)% or more (weldability requirement) | YP-EI (%) | Lower limit of optimal welding current (KA) | Fatigue limit of base metal under pulsating ($2 \times 10^6$) | Remarks |
|---|---|---|---|---|---|---|
| 0.2 | ≧0.3 | ≧0.78 | 0.3 | 7.0 | 172 | Comp. |
| 0.7 | ≧0.3 | ≧0.78 | 0.1 | 7.0 | 175 | |
| 1.5 | ≧0.3 | ≧0.78 | 0 | 6.0 | 177 | Inv. |
| 2.2 | ≧0.3 | ≧0.78 | 0 | 5.5 | 195 | |
| 3.0 | ≧0.3 | ≧0.78 | 0 | 5.5 | 225 | |

(Note)
Underlined condition is outside the scope of the invention.

INDUSTRIAL APPLICABILITY

As is apparent from the foregoing detailed description, according to the present invention, cold rolled steel sheets or galvanized steel sheets, for deep drawing, improved in fatigue properties of base metal and fatigue properties of spot weld zone can be provided without adding expensive elements such as Ti and Nb. Further, non-aging and BH properties also can be imparted. BH treatment results in further improved fatigue properties. Thus, the present invention provides inexpensive steel sheets with better usability for users, as compared with the conventional steel sheets, and a process for producing the same. Since expensive elements, such as Ti and Nb, are not used, the present invention can contribute to saving the earth's resources. Furthermore, the present invention can also provide high-strength steel sheets, which permit a reduction in weight, and, hence, may contribute to the environmental protection of the earth. Thus, the effect of the present invention is significant.

We claim:

1. An ultra low carbon, cold rolled steel sheet, improved in fatigue properties of a base metal and a spot weld zone, comprising by weight C: from more than 0.0015 to 0.0026%, Si: not, more than 1.2%, Mn: 0.03 to less than 0.3%, P: 0.015 to 0.15%, S: 0.0010 to 0.020%, Al: 0.005 to 0.15%, N: 0.0005 to 0.0080% and B: 0.0003 to 0.0030% with the balance consisting of Fe and unavoidable impurities.

2. The cold rolled steel sheet according to claim 1, which further comprises by weight at least one element selected from the group consisting of Ti: 0.0002 to 0.0015% and Nb: 0.0002 to 0.0015%.

3. The cold rolled steel sheet according to claim 1 wherein the chemical composition of the steel sheet is such that the B and N contents satisfy the following relationship: B/N>1.

4. An ultra low carbon, galvanized steel sheet, for deep drawing, improved in fatigue properties of a base metal and a spot weld zone, comprising by weight C: from more than 0.0015 to 0.0026%, Si: not more than 1.0%, Mn: 0.03 to less than 0.3%, P; 0.015 to 0.15% S: 0.0010 to 0.020%, Al: 0.005 to 0.15%, N: 0.0005 to 0.0080% and B:0.0003 to 0.0030% with the balance consisting of Fe and unavoidable impurities.

5. The galvanized steel sheet according to claim 4, which further comprises by weight at least one element selected from the group consisting of Ti: 0002 to 0.0015% and Nb: 0.0002 to 0.0015%.

6. The galvanized steel sheet according to claim 4, wherein the chemical composition is such that the B and N contents satisfy the following relationship: B/N>1.

7. A process for producing an ultra low carbon, cold rolled steel sheet, improved in fatigue properties of a base metal and a spot weld zone, comprising the steps of;

heating a slab, comprising by weight C: from more than 0.0015 to 0.0026%, Si: not more than 1.2%, Mn: 0.03 to less than a 0.3%, P:0.015 to 0.15%, S: 0.0010 to 0.020% Al: 0.005 to 0.15%, N: 0.0005 to 0.0080% and B: 0.0003 to 0.0030% with the balance Consisting of Fe and unavoidable impurities, to a temperature of 1050° C. or above;

hot rolling the heated slab and terminating the hot rolling at the $Ar_3$ transformation point or above; coiling the hot tolled strip in the temperature range of from room temperature to 750° C.; transferring the hot rolled coil to a cold rolling machine where it a cold rolled with a reduction ratio of not less than 70% continuously annealing the cold rolled strip in the temperature range of from 600° to 900° C.; and temper rolling the annealed string with a reduction ratio (%) falling within the range specified by the following formulae: $\%\geqq 1.5\times(1-400\times C)$, $\%\geqq 2080\times(C-0.0015)$, $\%\geqq 3.0$ and $0.0001\leqq C\leqq 0.0026$ wherein C represent the carbon content in % by weight.

8. The process according to claim 7, wherein the cold rolling is performed with a reduction ratio of not less than 84%.

9. The process according to claim 7, wherein the chemical composition of the slab is such that the slab further comprises by weight at least one element selected from the group consisting of Ti: 0.0002 to 0.0015% and Nb: 0.0002 to 0.0015%.

10. The process according to claim 7, wherein wherein the chemical composition of the slab is such that the B and N contents satisfy the following relationship: B/N>1.

11. A process for producing an ultra low carbon, galvanized steel sheet, improved in fatigue properties of a base metal and a spot weld zone, comprising the steps of;

heating a slab, comprising by weight C: from more than 0.0015 to 0.0026%, Si: not more than 1.0%, Mn: 0.03 to less than 0.3%k, P: 0.015 to 0.15%, S: 0.0010 to 0.020%, Al: 0.005 to 0.15%, N: 0.0005 to 0.0080% and B: 0.0003 to 0.0030% with the balance consisting of Fe and unavoidable impurities, to a temperature of 1050° C. or above;

hot rolling the heated slab and terminating the hot rolling at the $Ar_3$ transformation point or above; coiling the hot rolled strip in the temperature range of from room temperature to 750° C; transferring the hot rolled coil to a cold rolling machine where cold rolling is performed, with a reduction ratio of not less than 70%, while uncoiling the hot rolled strip; annealing the cold rolled strip in the temperature range of from 600° to 900° C. and then galvanizing the annealed strip; and temper rolling the galvanized strip with a reductions ratio (%) falling within the range specified by the following formulae: $\%\geqq 1.5\times(1-400\times C)$, $\%\geqq 2080\times(C-0.0015)$, $\%\leqq 3.0$ and $0.0001\leqq 0.0026$ wherein C represents the carbon content in % by weight.

12. The process according to claim 11, wherein the cold rolling is performed with a reduction ratio of not less than 84%.

13. The process according to claim 11, wherein the chemical composition of the slab is such that the slab further comprises by weight at least one element selected from the group consisting of Ti: 0.0002 to 0.0015% and Nb: 0.0002 to 0.0015%.

14. The process according to claim 11, wherein the chemical composition of the slab is such that the B and N contents satisfy the following relationship: B/N>1.

15. The process according to claim 7 wherein said hot rolling step comprises:

rough rolling said slab to provide a rough rolled strip having a thickness 30 to 70 mm;

coiling the rough rolled strip;

uncoiling the rough rolled strip and joining a front end of the uncoiled rough rolled strip to a rear end of an uncoiled preceding coiled rough rolled strip; then continuous finish hot rolling of said joined rough rolled strips to provide laid hot rolled strip.

16. The process according to claim 7 further comprising:

cooling said hot rolled strip starting within 1.5 sec after completion of hot rolling to 750° C. or below at a cooling rate of not less than 50° C. sec, and coiling said cooled hot rolled strip at a temperature range of from room temperature to 750° C.

17. The process according to claim 11 wherein said hot rolling step comprises;

rough rolling said slab to provide a rough rolled strip having a thickness 30 to 70 mm;

coiling the rough rolled strip;

uncoiling the rough rolled strip and joining a front end of the uncoiled rough rolled strip to a rear end of an uncoiled preceding coiled rough rolled strip; then continuous finish hot rolling of said joined rough rolled strips to provide said hot rolled strip.

18. The process according to claim 11 further comprising:

cooling said hot rolled strip starting within 1.5 sec after completion of hot rolling to 750° C. or below at a cooling rate of not less than 50° C./sec, and coiling said cooled hot rolled strip at a temperature range of from room temperature to 750° C.

* * * * *